United States Patent [19]

DeRoss et al.

[11] Patent Number: 4,660,917

[45] Date of Patent: Apr. 28, 1987

[54] MULTI-WIRE INSULATION DISPLACEMENT TERMINAL

[75] Inventors: Robert DeRoss, Naperville; Joseph J. Gierut, Tinley Park, both of Ill.

[73] Assignee: Molex Incorporated, Lisle, Ill.

[21] Appl. No.: 811,977

[22] Filed: Dec. 23, 1985

[51] Int. Cl.[4] ..... H01R 4/24

[52] U.S. Cl. ..... 339/97 R; 339/261

[58] Field of Search ..... 339/97 R, 98, 99 R, 339/261

[56] References Cited

U.S. PATENT DOCUMENTS

| | | | |
|---|---|---|---|
| 3,845,455 | 10/1974 | Shoemaker | 339/97 R |
| 4,220,390 | 9/1980 | Cobaugh et al. | 339/97 R |
| 4,344,665 | 8/1982 | Racilla et al. | 339/99 R |
| 4,538,872 | 9/1985 | Brubaker et al. | 339/97 P |
| 4,575,173 | 3/1966 | Chapin et al. | 339/97 R |

FOREIGN PATENT DOCUMENTS 67298 2/1951 Netherlands .

*Primary Examiner*—Joseph H. McGlynn

*Attorney, Agent, or Firm*—Louis A. Hecht; John W. Cornell

[57] ABSTRACT

A terminal for making electrical connections to insulation clad wires includes a base portion and a pair of U-shaped elements each formed of a side wall extending upwardly from the base portion and a pair of end portions extending from the side wall. The U-shaped elements are formed at opposite sides of the base portion and the end portions, each defining one slot, extend more than half way toward the opposed side wall. A compact arrangement is achieved by internesting the U-shaped elements. Insulation displacement slots of different widths are provided for termination of wires of different gauges.

3 Claims, 16 Drawing Figures

MULTI-WIRE INSULATION DISPLACEMENT TERMINAL

BACKGROUND OF THE INVENTION

1. Field of the Invention

The present invention relates to electrical terminals for making insulation displacement connections to wires, and more particularly to an improved terminal providing more than a single pair of insulation displacement slots in a very compact configuration.

2. Description of the Prior Art

Insulation displacement terminals are widely used to make electrical connections with insulation clad wires because the step of removing insulation from the conductor prior to termination of the wire is eliminated. Many different types of insulation displacement terminals have been employed in the past. In one configuration, called an in-line terminal, a wire is terminated with its axis aligned with the major axis of the terminal providing a trim configuration useful where in-line wire exit from a connector is desired.

U.S. Pat. No. 3,760,331 discloses an insulation displacement terminal with a base, a pair of opposed sidewalls, and end portions extending toward one another to define a pair of spaced-apart insulation displacement slots between the end portions. With this type of terminal, an undesirably large amount of space is required if more than a single pair of insulation displacement slots are needed. For example, more than one pair of slots may be useful for connecting more than a single wire to the terminal.

U.S. Pat. No. 4,538,872 discloses a contact with U-shaped members formed at either side of a base portion. The legs of the U-shaped members extend across or nearly across the width of the base portion and insulation displacement slots are provided in two of the legs rather than being defined between adjacent legs. Two pairs of slots, for a total of four, could be provided in this contact configuration, but this would require a terminal having substantial axial length.

Dutch Pat. No. 67,298 issued Feb. 15, 1951 discloses at FIG. 9 a terminal having three insulation displacement slots in a linear array. One slot of a narrow configuration receives a narrow conductor 29, while the other slots are wider and receive a heavy gauge conductor cable 26. Ribs forming the narrow slot are lower than the remaining ribs so that the larger conductor 26 may be received above the narrower conductor 29 without entering the narrower slot.

SUMMARY OF THE INVENTION

Among the objects of the present invention are to provide an improved electrical terminal including more than a pair of slots; to provide a terminal for making electrical connections to more than one wire and to wires of different gauges; to provide a terminal including more than a pair of insulation displacement slots and having smaller space requirements than terminals used for this purpose in the past; and to provide a terminal overcoming disadvantages of multi-wire insulation displacement terminals employed in the past.

In brief, in accordance with the above and other objects of the invention, there is provided a terminal for making electrical connections to insulation clad wires. The terminal is a unitary body of uniform thickness sheet metal stock having a generally flat, planar base portion. A pair of sidewalls generally parallel to each other extend upwardly from opposite sides of the base portion. A pair of end portions extend inwardly from each sidewall toward the opposite sidewall so that each sidewall with its pair of end portions defines a generally U-shaped element. The end portions extend more than half the distance from one sidewall to the opposite sidewall. The U-shaped elements are internested with one another and at least one end portion of one element is located between the end portions of the opposite element. Wires are received in insulation displacement slots, each slot being defined in one of the end portions.

BRIEF DESCRIPTION OF THE DRAWINGS

The present invention together with the above and other objects and advantages may be best understood from the following detailed description of the preferred embodiments of the invention illustrated in the drawings, wherein.

DETAILED DESCRIPTION OF THE PREFERRED EMBODIMENTS

Figure 1:
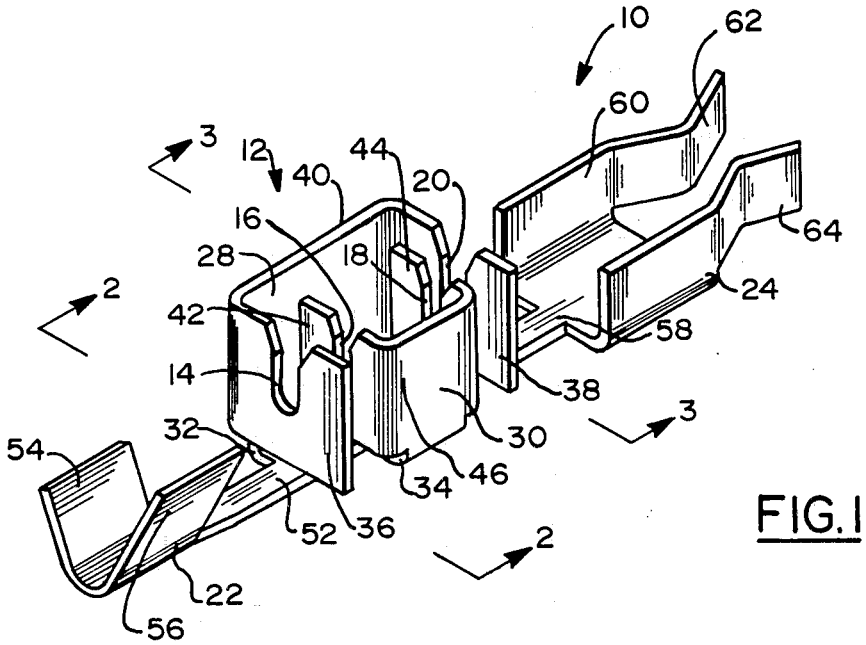
FIG. 1 is a perspective view of a terminal constructed in accordance with the present invention.
Figure 2:
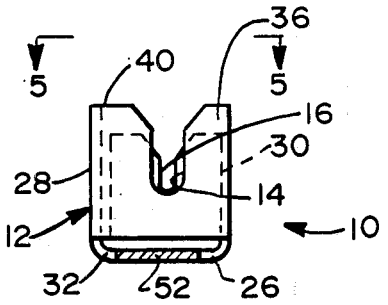
FIG. 2 is a sectional view taken along the line 2—2 of FIG. 1.
Figure 3:
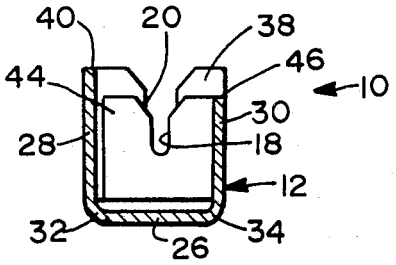
FIG. 3 is a sectional view taken along the line 3—3 of FIG. 1.

With reference now to the drawings, in FIGS. 1–5 there is illustrated an electrical terminal designated as a whole by the reference numeral 10 and constructed in accordance with the principles of the present invention. In general, terminal 10 includes a wire engaging portion or insulation displacement contact structure generally designated as 12 providing in a very compact arrangement four different generally colinear insulation displacement slots 14, 16, 18 and 20 into which more than one wire may be terminated. In the illustrated embodiment of the invention, terminal 10 further includes a strain relief portion 22 engageable with wires connected to terminal 10 and a spring contact portion 24 for connection to external circuitry such as, for example, a contact pin or circuit board edge. In use, one or more terminals 10 may be mounted in an insulating housing (not shown) to form an electrical connector.

Contact structure 12 includes a generally flat, planar base portion 26 from which a pair of sidewalls 28 and 30 extend upwardly (in the orientation shown in the drawing). Side walls 28 and 30 are joined to base portion 26 by folded connecting portions 32 and 34 integral with opposed sides of base portion 26.

Figure 5:
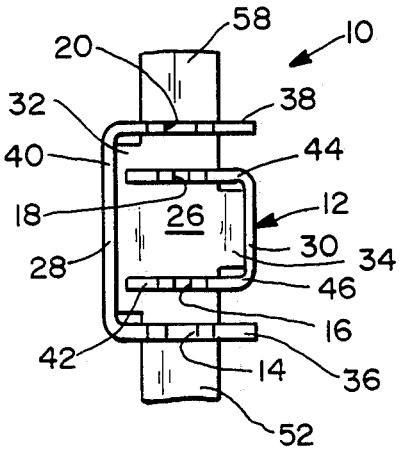
FIG. 5 is an elevational view of part of the terminal of FIG. 1.

A pair of end portions 36 and 38 extend inwardly from sidewall 28 toward sidewall 30. End portions 36 and 38 together with sidewall 28 form a generally U-shaped element 40 as best seen in FIGS. 1 and 5. Similarly, end portions 42 and 44 extend inwardly from sidewall 30 toward the opposed sidewall 28 and, together with sidewall 30, form a second U-shaped element 46.

In accordance with the present invention, one of the slots 14–20 is defined entirely in one of the end portions 36, 38, 42 and 44, with one slot being formed in each end portion. In this way, the two U-shaped elements 40 and 46 provide four different insulation displacement slots. Also in accordance with the invention, the U-shaped elements 40 and 46 are internested together to provide an extremely compact arrangement using a minimum of space in the axial direction.

In the configuration of FIGS. 1–5, the internesting is accomplished by locating both end portions 42 and 44 of U-shaped element 46 between the end portions 36 and 38 of U-shaped element 40. In order to accomplish this compact arrangement, the U-shaped element 46 is smaller than the U-shaped element 48 in the axial direction.

Since the contact structure 12 of terminal 10 includes two pairs of insulation displacement slots for a total of four, it is possible to terminate more than a single wire while retaining the advantages of redundant slot termination for each wire. In the configuration of terminal 10, slots 16 and 18 are narrower in width than slots 14 and 20 so that wires of different gauges can be accommodated. Alternatively, if desired, slots of equal or unequal width could be employed in pairs to form a splice termination between two coaxial wires.

Figure 4:
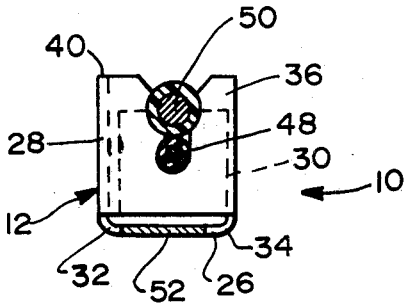
FIG. 4 is a view similar to FIG. 2 illustrating the terminal after termination of wires of different gauges.

FIG. 4 illustrates terminal 10 with two insulation-clad wires 48 and 50 terminated to contact structure 12. To facilitate entry of wires into the slots 14–20, each slot may be provided as illustrated with a beveled entry portion. In use of terminal 10, smaller gauge wire 48 is first inserted from above the terminal toward the base portion 26 into the colinearly arrayed slots. Wire 48 is received relatively freely into the wider slots 14 and 20. As the wire enters the narrower slots 16 and 18, its insulation cladding is displaced and electrical contact is made to the central conductor. After the smaller wire 48 is inserted, the larger gauge wire 50 is terminated. As this wire enters slots 14 and 20, its insulation cladding is displaced and electrical contact is made to the central conductor.

In accordance with the invention, the end portions 36 and 38 of U-shaped element 40 extend upwardly further from base portion 26 than do the end portions 42 and 44 of the U-shaped element 46. As a result, when the larger wire 50 is terminated, it does not enter the narrow width portions of slots 16 and 18 and damage to or weakening of the wire 50 is avoided.

Strain relief portion 22 may be employed to mechanically secure the wires 48 and 50 to the terminal 10 during or after insertion of the wires into the slots 14–20. Strain relief portion 22 includes a neck portion 52 extending from an end of base portion 26 in a direction generally parallel to the wire direction. A pair of strain relief arms 54 and 56 may be deformed to grip the insulation of wires 48 and/or 50. Neck portion 52 may be sloped or angled to elevate arms 54 and 56 so that wires 48 and 50 extend generally in a straight line (parallel to base 26) from slots 14–20 through the strain relief portion 22.

When wires 48 and 50 are terminated, they are electrically connected to one another by terminal 10. Spring contact portion 24 may be used to establish an electrical connection between wires 48 and 50 and an external circuit. Spring contact portion 24 includes a neck portion 58 extending generally in the axial direction from an end of base portion 26. A contact box portion 60 is integral with the neck portion 58 and includes a pair of spring arms 62 and 64. Arms 62 and 64 are configured to receive therebetween a conductive element associated with an external circuit, such as a conductive pad portion at the edge of a printed circuit board or a male pin terminal.

Figure 6:
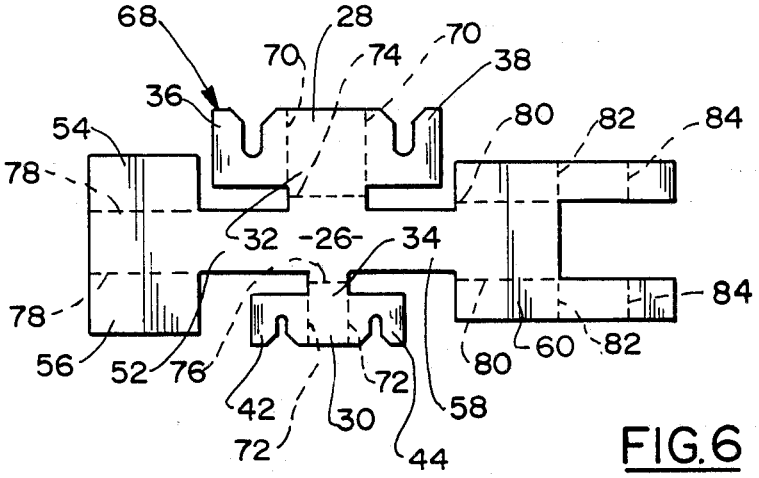
FIG. 6 is an elevational view of a blank from which the terminal of FIGS. 1–5 may be formed.

One way of fabricating the terminal 10 from sheet metal stock is illustrated in FIG. 6. A flat sheet metal blank 68 may be stamped from a web or strip of sheet metal and the terminal 10 can be formed in progressive operations. The U-shaped elements 40 and 46 are formed by bending end portions 36 and 38 relative to sidewall 28 along fold lines 70 and by bending end portions 42 and 44 relative to sidewall 30 along fold lines 72. Side walls 28 and 30 are formed upwardly, generally perpendicular to the plane of the stock and of base portion 26 by bending along fold lines 74 and 76 located respectively in the connecting portions 32 and 34.

The strain relief portion 22 is shaped by forming a slope or angle in neck portion 52 and by bending the strain relief arms 54 and 56 upwardly along fold lines 78. Spring contact portion 24 is made by bending the sides of contact box portion 60 upwardly along fold lines 80 and by shaping the spring contact arms 62 and 64 by bending along fold lines 82 and 84.

Figure 7:
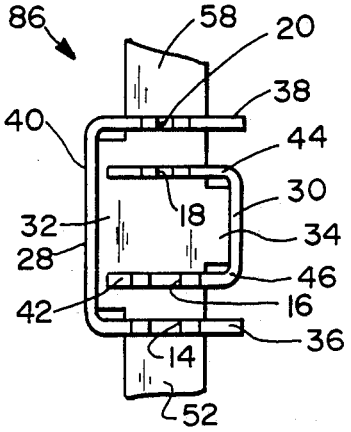
FIG. 7 is an elevational view similar to FIG. 5 of an alternative embodiment of the invention.
Figure 8:
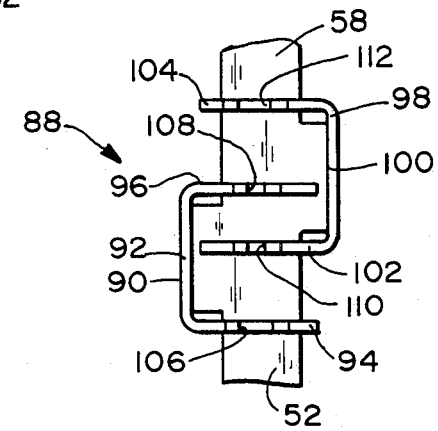
FIG. 8 is an elevational view similar to FIG. 5 of an alternative embodiment of the invention.

FIGS. 7 and 8 are elevational views showing terminal contact structures 86 and 88 similar in many respects to the contact structure 12 described above and shown in FIGS. 1–5. Due to the similarities, contact structures 86 and 88 are not described in detail, and similar reference numerals are employed for similar parts of the contact structures.

With reference first to FIG. 7, contact structure 86 is similar to contact structure 12 described above except in the arrangement of slots 14–20. In contact 86, slots 14 and 16 are relativley wide for a larger gauge wire while slots 18 and 20 are narrower for a relatively smaller gauge wire. Wires of different sizes such as wires 48 and 50 may be terminated to contact structure 86 in an overlying relationship of the same type illustrated in FIG. 4 by making the wall portions 38 and 44 of a smaller vertical height than the wall portions 36 and 42. Alternatively, if desired, contact structure 86 may be used to splice coaxial wires with a smaller gauge wire in slots 18 and 20 and a larger gauge wire in slots 14 and 16.

FIG. 8 illustrates a different way of internesting two U-shaped elements in a compact configuration. A first U-shaped element 90 is formed of a sidewall 92 and end portions 94 and 96. A second U-shaped element 98 is formed of a sidewall 100 and end portions 102 and 104. Slots 106, 108, 110 and 112 are defined in end portions 94, 96, 102 and 104 respectively.

Internesting is accomplished by locating end portion 102 of U-shaped element 98 between end portions 94 and 96 of U-shaped element 90, and by locating end portion 96 of U-shaped element 90 between end portions 102 and 104 of U-shaped element 98. Slots 108 and 110 are of a relatively narrow width for accomodating a smaller gauge wire, while slots 106 and 112 are of a relatively wider width for accommodating a larger gauge wire.

If desired, the contact structures 86 and 88 may be associated with strain relief portions and/or spring contact portions such as the portions 22 and 24 described above with reference to terminal 10.

FIGS. 9–16 show an alternative embodiment of a terminal and contact structure according to the present invention. The electrical terminal is designated as a whole by the reference numeral 210, and is constructed in accordance with the principles of the present invention. Terminal 210 includes an elongate wire engaging portion or insulation displacing contact structure, generally designated by the reference numeral 212, providing five different, generally co-linear, insulation displacing slots 248, 250, 252, 262, and 264 into which more than one insulation-clad wire may be terminated. In the illustrated embodiment of the invention, terminal 210 further includes a strain relief portion 276 engageable with wires connected to terminal, and a cylindrical receptacle contact portion 224 for connection to external circuitry such as, for example, a contact pin. As with other aforedescribed embodiments of the present invention, one or more terminals 210 may be mounted in an insulating housing 211 to form an electrical connector. Contact structure 212 includes an elongate generally flat, planar base portion 226 having opposed elongate edges **226*a*, 226*b*. A pair of wall constructions 228, 230 extend upwardly (in the orientation shown in the drawing) from the edges, and are joined to base portion 226 by folded connecting portions 232, 234**.

The first wall construction 228 is (ignoring its mounting wall 236) generally S-shaped, consisting of three sidewalls 236, 238 and 240. Sidewalls 236, 240 are generally co-planar, and extend upwardly above base portion 226, at one elongate edge **226*a* thereof. The middle sidewall 238 also extends upwardly from base 226, but at an opposing elongate edge 226*b*. The sidewalls 236, 238 and 240 interconnect three end portions 242, 244 and 246. Each of the end portions 242, 244 and 246 contain an insulation displacing slot, reference numerals 248, 250 and 252, respectively. The outer slots 248, 252 are of a larger size to accommodate a larger diameter wire WL and, the intermediate slot 250 is of a smaller size for accommodating a smaller gauge wire WS. The larger gauge slots 248, 252 are deeper than would otherwise be necessary for termination to an insulation-clad wire, to allow downward clearance of the lower, smaller gauge wire, passing through the respective end portions 242, 246. Structure 228 forms a generally S-shaped element 268 having a rearward U-shaped portion 270 formed by sidewall 240 and end portions 244, 246**.

Figure 10:
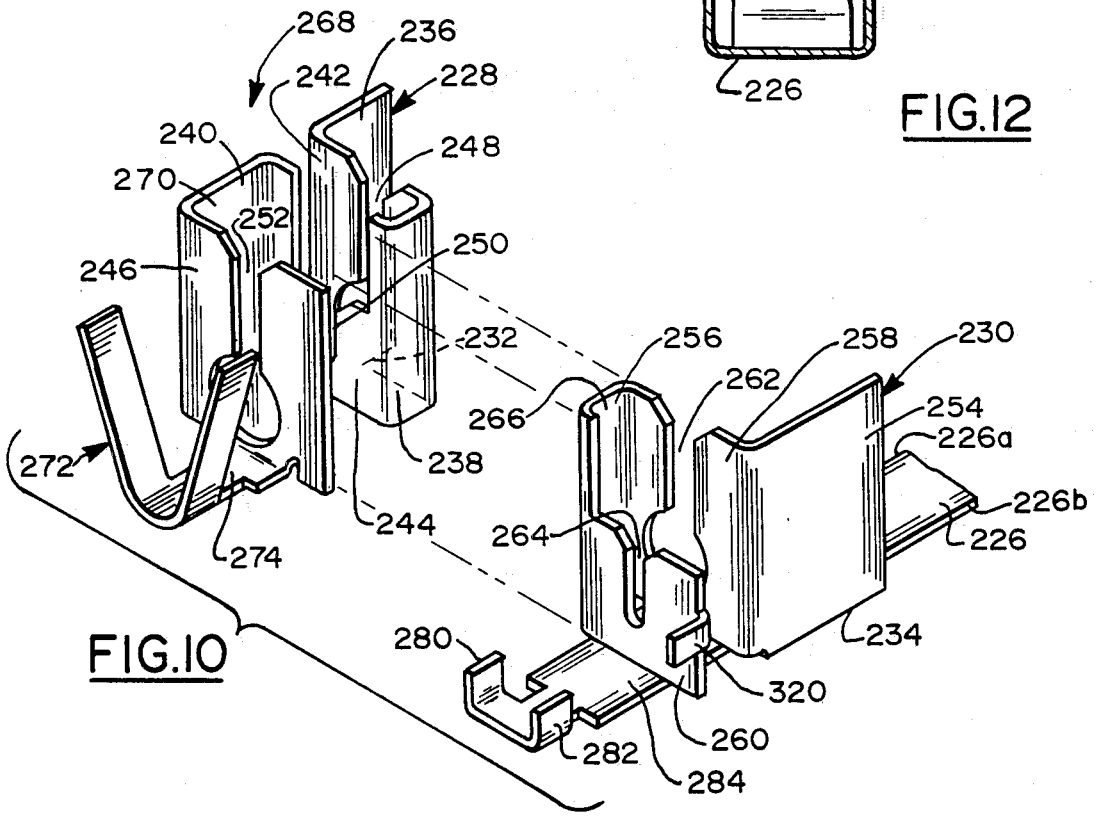
FIG. 10 is an exploded perspective view of the internested portions of the terminal of FIG. 9.
Figure 11:
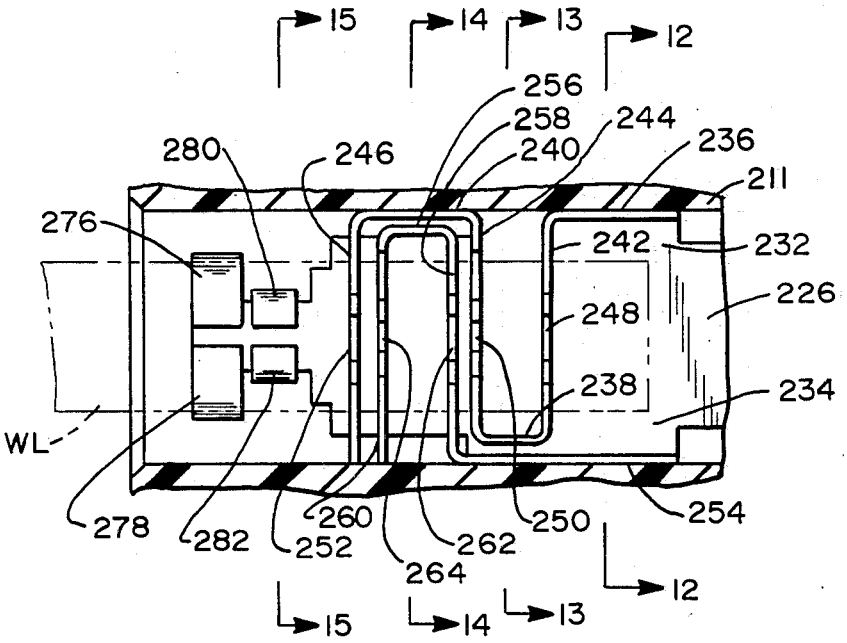
FIG. 11 is an elevational view of the terminal of FIGS. 9 and 10.
Figure 13:
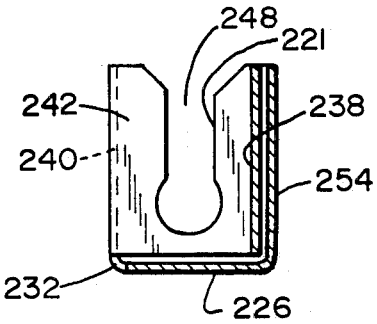
Figure 14:
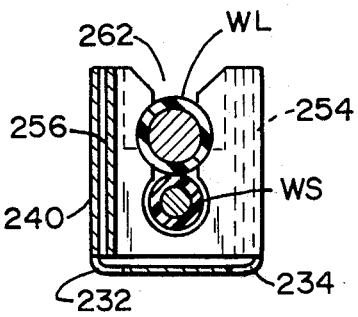
Figure 15:
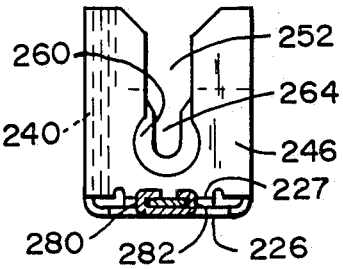

The second wall structure 230 is shown in the bottom righthand portion of FIG. 10, and comprises the pair of opposed sidewalls 254, 256 which are joined to end portions 258, 260. End portions 258, 260 include a deeper, larger gauge insulation displacing slot 262, and a shallower, smaller gauge insulation displacing slot 264, respectively. Except for its mounting wall 240, structure 230 defines a generally U-shaped element 266. The insulation displacing slots 248–252 252 and 262–264 are each defined entirely in their respective end portions 242–246 and 258–260. As indicated in FIG. 10, the two sidewalls 236, 254 of first and second wall structures 228, 230 are the only walls joined to base portion 226, and they are joined through folding connecting portions 232, 234, respectively. In accordance with the present invention, each end portion in each embodiment extends more than half the (lateral) distance between opposed elongate edges of the terminal base portion. This allows each insulation displacing slot to be formed entirely within a single end portion.

Also in accordance with the invention, the U-shaped element 266 of wall structure 230 is internested within the S-shaped element 268 of wall structure 228. More specifically, the U-shaped element 266 is nested between end portions 244, 246 of wall structure 228. When so assembled, the sidewall 256 of structure 230 is immediately adjacent the sidewall 240 of structure 228, both lying above the first elongate edge **226*a* of base portion 226. In order to accomplish this contact arrangement, the U-shaped element 266 is smaller than the U-shaped portion 270 of the first wall structure 228. This is conveniently provided by making the sidewall 240 wider than the sidewall 256, both widths measured in the axial direction of elongate terminal 210**. When fully assembled, all of the insulation displacing slots are aligned in a co-linear arrangement.

In accordance with the present invention, the end portions 242, 246, and 258 extend upwardly further from base portion 226 than do the end portions 244, 260. As a result, when a larger wire is terminated, it does not enter the narrow portions of insulation displacing slots 250, 264 to damage or otherwise weaken those precisely configured slots. The fifth end portion provided in this alternative embodiment accommodates a larger gauge wire having a heavier current carrying capacity than can be supported by two end portions and two corresponding insulation displacing slots.

Strain relief portion 272 may be employed to mechanically secure the wires WL, WS to terminal 210 during or after insertion of the wires in their corresponding insulation displacing slots. Strain relief portion 272 includes a neck portion 274 extending from an end of base portion 226 in a direction generally parallel to the wire direction. A pair of strain relief arms 276, 278 may be deformed to grip the insulation of the wires. The neck portion 274 is sufficiently elongated in an axial direction to provide engagement of clinch-like engaging ears 280, 282 which are joined to end portion 260 through a second neck 284. Engaging ears 280, 282 provide interconnection of the two wall structures 228, 230 at the rearward portion of terminal 210 preventing axial displacement of those two wall structures when a tension force is applied to the wires. If desired, base portion 226 can be extended in a rearward direction so as to underlie neck 284. Spot welding, cold forming or the like securement can be provided between neck portion 284 and base portion 226 to provide a rigid interconnection between the two wall structures and the base portion, at the rearward end of the terminal.

The forward end of terminal 210, generally designated by the reference numeral 224, can take any suitable form for connecting to an external electrical circuit. In the embodiment shown in FIGS. 9–16, mating portion 224 comprises a cylindrical-like receptacle member for separable mating with a male pin terminal.

Figure 16:
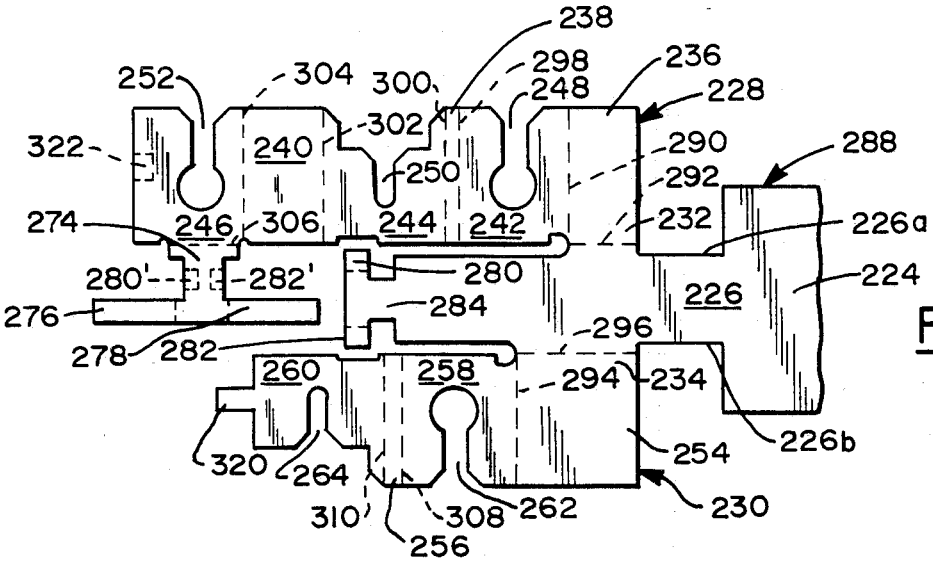
FIG. 16 is an elevational view of a blank from which the terminal of FIGS. 9–15 may be formed.

One way of fabricating the terminal 210 from sheet metal stock is illustrated in FIG. 16. A flat sheet metal blank 288 may be stamped from a web or strip of sheet metal, and the terminal 210 can be formed in progressive operations. The wall structure 228 is formed by bending the end portions and sidewalls of that structure about several fold lines, beginning with the leading fold line 290. The formed wall structure is then upwardly bent in a vertical orientation along fold line 292 to define the folded connecting portion 232. Similarly, the second wall structure 230 is formed by folding that structure along several fold lines, including the leading fold line 294. The wall structure, when so formed, is upwardly bent into a vertical orientation, by folding about line 296, thereby forming folded connecting portion 234.

Referring to the first wall structure 228, end portion 242 is formed by bending about fold lines 290 and 298. The sidewall 238, extending between end portions 242, 244 is completed by bending along fold line 300. The rearward sidewall 240 is formed by folding about lines 302, 304. End portion 246 is completed by bending about fold line 306 so that neck portion 274 is generally perpendicular thereto. When the folding wall structure 228 is completed, the structure is bent into an upward vertical direction about line 292, to form the orientation shown most clearly in FIG. 10.

Figure 9:
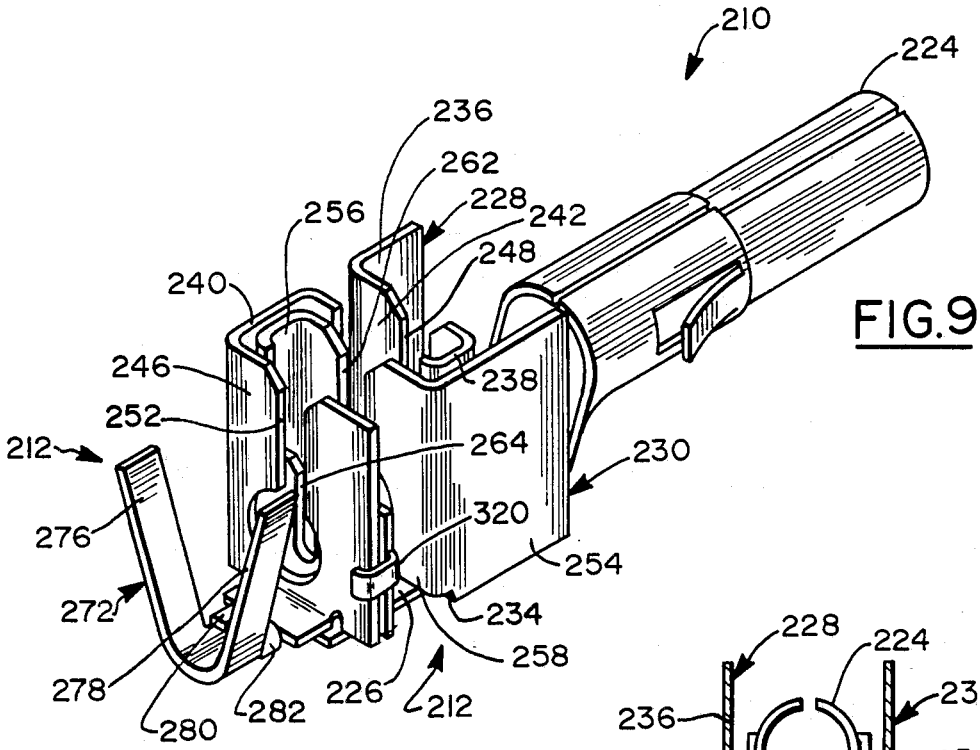
FIG. 9 is a perspective view of an alternative embodiment of the terminal constructed in accordance with the present invention.
Figure 12:
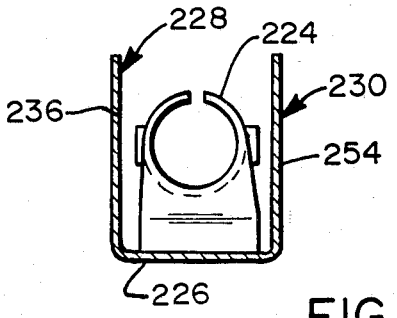
FIGS. 12–15 are cross-sectional views taken along the lines 12—12, 13—13, 14—14 and 15—15, respectively of FIG. 11.

The generally U-shaped element 266 of the second wall structure 230 is completed by folding along lines 308, 310 to form sidewall 256 generally perpendicular to end portions 258, 260. Thereafter, the formed wall structure is bent about line 296 to form folded connecting portion 234. During this final bending operation, the U-shaped element 266 is internested within the U-shaped portion 270 of S-shaped element 268, as indicated in FIG. 9. Thereafter, if additional interconnection between wall structures is required, a securement tab 320, formed at the free end of end portion 260, can be bent over the free end of end portion 246. The engagement is identified by phantom outline 322, shown at the rearward portion of wall structure 228.

In any event, engaging ears 280, 282, initially positioned beneath neck portion 274, clinched around that neck portion to interconnect the free end of wall structure 228 with base portion 226.

We claim:

1. A terminal for making electrical connections to insulation clad wires, said terminal comprising a unitary body of uniform thickness sheet metal stock, said terminal having an elongate wire engaging portion extending parallel to said wires and a generally flat, coextensive planar base portion with opposed elongate edges, a pair of sidewalls generally parallel to one another and extending upwardly above said base portion at least one elongate edge thereof, a pair of end portions extending from each sidewall toward the opposite elongate edge, each sidewall with its pair of end portions defining a generally U-shaped element, and insulation displacement slot means defined between said sidewalls, said terminal being characterized by:

each end portion extending more than half the distance between the base portion elongate edges;

said U-shaped elements being internested with at least one end portion of one element being located between the end portions of the opposite element;

said pair of sidewalls being immediately adjacent each other at one elongate edge of said base portion, and one of said elements includes a third end portion joined to one of said two end portions through a second, opposing sidewall, whereby said U-shaped element is extended to form a generally S-shaped element; and a generally co-linear array of insulation displacement slots, each being defined in one of said end portions.

2. The terminal claimed in claim 1 wherein the slots of said S-shaped element are larger than the slot formed in said other element, to receive insulation-clad wires of different sizes.

3. The terminal claimed in claim 1 further comprising a segment extending from said base portion and defining contact means for connection to an external circuit.

* * * * *